US005428345A

United States Patent [19]

Bruno

[11] Patent Number: 5,428,345

[45] Date of Patent: Jun. 27, 1995

[54] METHOD OF AND APPARATUS FOR OPERATING A SECURITY SYSTEM TO PRODUCE AN ALARM SIGNAL

[75] Inventor: David A. Bruno, Portland, Oreg.

[73] Assignee: Sentrol, Inc., Tualatin, Oreg.

[21] Appl. No.: 221,025

[22] Filed: Mar. 30, 1994

[51] Int. Cl.[6] ..... G08B 13/00

[52] U.S. Cl. ..... 340/541; 340/521; 340/528; 340/529; 340/550; 340/567

[58] Field of Search ..... 340/541, 522, 526, 527, 340/528, 529, 567, 550

[56] References Cited

U.S. PATENT DOCUMENTS

| | | | |
|---|---|---|---|
| 3,487,397 | 12/1969 | Kaplan et al. | 340/261 |
| 4,134,109 | 1/1979 | McCormick et al. | 340/550 |
| 4,241,338 | 12/1980 | Spirig | 340/566 |
| 4,410,884 | 10/1983 | Heiland | 340/545 |
| 4,532,507 | 7/1985 | Edson et al. | 340/825.31 |
| 4,577,183 | 3/1986 | Fontaine | 340/541 |
| 4,642,612 | 2/1987 | Crump | 340/541 |
| 4,745,400 | 5/1988 | Miura | 340/541 |
| 4,746,910 | 5/1988 | Pfister et al. | 340/567 |
| 4,749,985 | 6/1988 | Corsberg | 340/517 |
| 4,810,998 | 3/1989 | Hwang | 340/541 |
| 4,812,819 | 3/1989 | Corsberg | 340/517 |
| 4,833,450 | 5/1989 | Buccola et al. | 340/506 |
| 4,845,464 | 7/1989 | Drori et al. | 340/429 |
| 4,882,567 | 11/1989 | Johnson | 340/522 |
| 4,996,515 | 2/1991 | Schaffer et al. | 340/426 |
| 5,057,817 | 10/1991 | Berube | 340/506 |
| 5,077,548 | 12/1991 | Dipoala | 340/522 |
| 5,083,106 | 1/1992 | Kostusiak | 340/541 |
| 5,084,697 | 1/1992 | Hwang | 340/541 |
| 5,107,249 | 4/1992 | Johnson | 340/541 |
| 5,172,093 | 12/1992 | Nose | 340/527 |
| 5,185,593 | 2/1993 | DuRand et al. | 340/544 |
| 5,189,393 | 2/1993 | Hu | 340/522 |
| 5,192,931 | 3/1993 | Smith et al. | 340/550 |
| 5,276,427 | 1/1994 | Peterson | 340/522 |
| 5,323,141 | 6/1994 | Petek | 340/541 |

*Primary Examiner*—John K. Peng
*Assistant Examiner*—Albert K. Wong
*Attorney, Agent, or Firm*—Stoel Rivers Boley Jones & Grey

[57] ABSTRACT

A security system (10), operable to produce an ALARM signal indicative of glass breakage in a region (16) in which a human being (24) may legitimately be present, has a human presence detector (12), a glass breakage detector (14), and an alarm signal activator (30) that includes a one-shot timer (52). A HUMAN PRESENCE DETECT signal (36, 38) output from the human presence detector triggers or retriggers the timer to produce an active output for a predetermined holdoff time interval $T_H$. The active output causes a gate (58) to prevent a glass breakage alarm or GB DETECT pulse (46) from the glass breakage detector from reaching a control panel (34) and thus from triggering the ALARM signal if the GB DETECT signal occurs within the holdoff time interval after a HUMAN PRESENCE DETECT signal. Another gate (64) prevents a GB DETECT pulse (48) from reaching the control panel if that pulse occurs while the human presence detector is detecting human presence in the region (38). A GB DETECT signal (44, 50) that occurs at any other time reaches the control panel and triggers the ALARM signal (86, 88). The system may also activate a service or illumination unit (90) to provide a service or illumination to the region following a HUMAN PRESENCE DETECT state or may trigger a HUMAN PRESENCE ALARM pulse (100) when a HUMAN PRESENCE DETECT state arises when a REGION UNOCCUPIED signal has been activated.

33 Claims, 2 Drawing Sheets

METHOD OF AND APPARATUS FOR OPERATING A SECURITY SYSTEM TO PRODUCE AN ALARM SIGNAL

TECHNICAL FIELD

The invention pertains to security systems that use a glass breakage detector to detect an attempt to enter a structure by breaking a pane of glass.

BACKGROUND OF THE INVENTION

Acoustic glass breakage detectors are used in security systems for homes and other structures to detect an attempt by an intruder to enter the structure by breaking a pane of glass such as found in a window or a glass door. Such detectors are normally installed inside the structure so that an intruder cannot disable or disarm them from outside the structure.

Most such detectors work by using a microphone to detect acoustic information or sounds, analyzing the sounds to extract a reduced set of significant parameters, and comparing the values of that set of parameters against the values of a set of predetermined glass break parameters that correspond to a glass breakage event. If the values of the set of significant parameters have a predetermined relationship with the values of the set of predetermined glass breakage parameters, a signal is generated to a central alarm control panel, which then generates an alarm (as an example, a siren) audible locally at the structure and/or a remote alarm (as an example, an alarm signal transmitted by telephone or radio). Sounds for which the values of the set of significant parameters do not have the predetermined relationship with the values of the set of predetermined glass breakage parameters do not lead to an alarm signal.

A home or business owner ordinarily can set the control panel to arm or disarm a glass breakage detector. Historically, control panels have been set to arm such a detector only in a structure that is not occupied by people and therefore is relatively quiet. As an example, such a detector has typically been armed to protect a business only when all employees have left, and the business has closed, for the night.

It would be desirable to arm an acoustic glass breakage detector to protect a person legitimately present in a structure from possible harm caused by an intruder. A locally audible alarm triggered by a glass breakage event could deter an intruder and could warn the legitimate occupant. The glass breakage event could also be signalled to a remote location so that authorities can be called to the structure.

Unfortunately, acoustic glass breakage detectors of the types now commercially available are not able to distinguish many common household or business sounds from true glass breakage events. Serious problems are caused by false alarms when such a detector is armed to protect a structure having a legitimate occupant. Thus, such a detector is typically not armed when someone is legitimately present in a structure to be protected because the risk of false alarms is intolerably high.

SUMMARY OF THE INVENTION

One object of the invention is thus to provide a security system using an acoustic glass breakage detector that can practicably be used to protect a structure in which a person may legitimately be present against intrusion that includes a glass breakage event.

Another object of the invention is to provide a method of operating a security system that includes an acoustic glass breakage detector so that the system is much less likely to generate a false alarm signal when armed to protect such a structure.

A further object of the invention is to fulfill the preceding objects while using an acoustic glass breakage detector of the types now commercially available.

The present invention includes a method of operating a security system to produce an alarm signal more reliably indicative of glass breakage in a region such as a room in which a person may legitimately be present. The method includes detecting with a human presence detector the presence of a human being in the region and detecting with a glass breakage detector the occurrence of an event that may indicate glass breakage. An alarm signal activator produces an alarm signal only in response to detection of such an event that occurs other than in a predetermined holdoff time interval after a detection by the human presence detector of human presence in the region and other than while the human presence detector is detecting human presence in the region.

The invention also includes a security system that has a human presence detector operatively coupled to such a region. The human presence detector produces a human presence detect signal whenever it detects human presence in the region. The security system also includes a glass breakage detector that produces a glass breakage signal whenever it detects sounds indicating an event that may indicate glass breakage. The human presence detect signal triggers a timer that prevents any glass breakage signal produced within the holdoff time interval after a production of the human presence detect signal from producing an alarm signal. The human presence detect signal also prevents any glass breakage signal that occurs while the human presence detect signal is active from producing the alarm signal.

The invention greatly reduces the incidence of false alarms when people are legitimately present in a structure in which an acoustic glass breakage detector is armed. Most such false alarms are caused by people working or living in the same room as the glass breakage detector. Each instance of detectable human presence in that room produces a human presence detect signal; the glass breakage detector is effectively "disarmed" for the holdoff time interval after a detection of human presence and for the time human presence in the region is detected. The invention may thus employ a human presence detector of a type that produces relatively short human presence detect signals or of a type that produces relatively long human presence detect signals. A person who legitimately (i.e., other than by breaking glass) enters a room protected by the security system is unlikely to produce sound that would cause the glass breakage detector falsely to indicate a glass breakage event before the human presence detector senses that person's presence and "disarms" the glass breakage detector.

The invention does not seriously compromise the security of people legitimately present in the room. An intruder is unlikely to break the glass of a room in which people are present. The security of people legitimately present in a room is not compromised even when the human presence detector includes only a motion detector unit. A person legitimately present in a region but substantially immobile (e.g., sleeping or reading) for more than the holdoff time interval since the last detection of human motion in the region is unlikely to move so as to activate the motion detector but also is unlikely to produce sound that would cause the glass breakage detector falsely to indicate a glass breakage event.

Additional objects and advantages of the present invention will be apparent from the detailed description of preferred embodiments thereof, which proceeds with reference to the accompanying drawings.

DETAILED DESCRIPTION OF A PREFERRED EMBODIMENT

Figure 1:
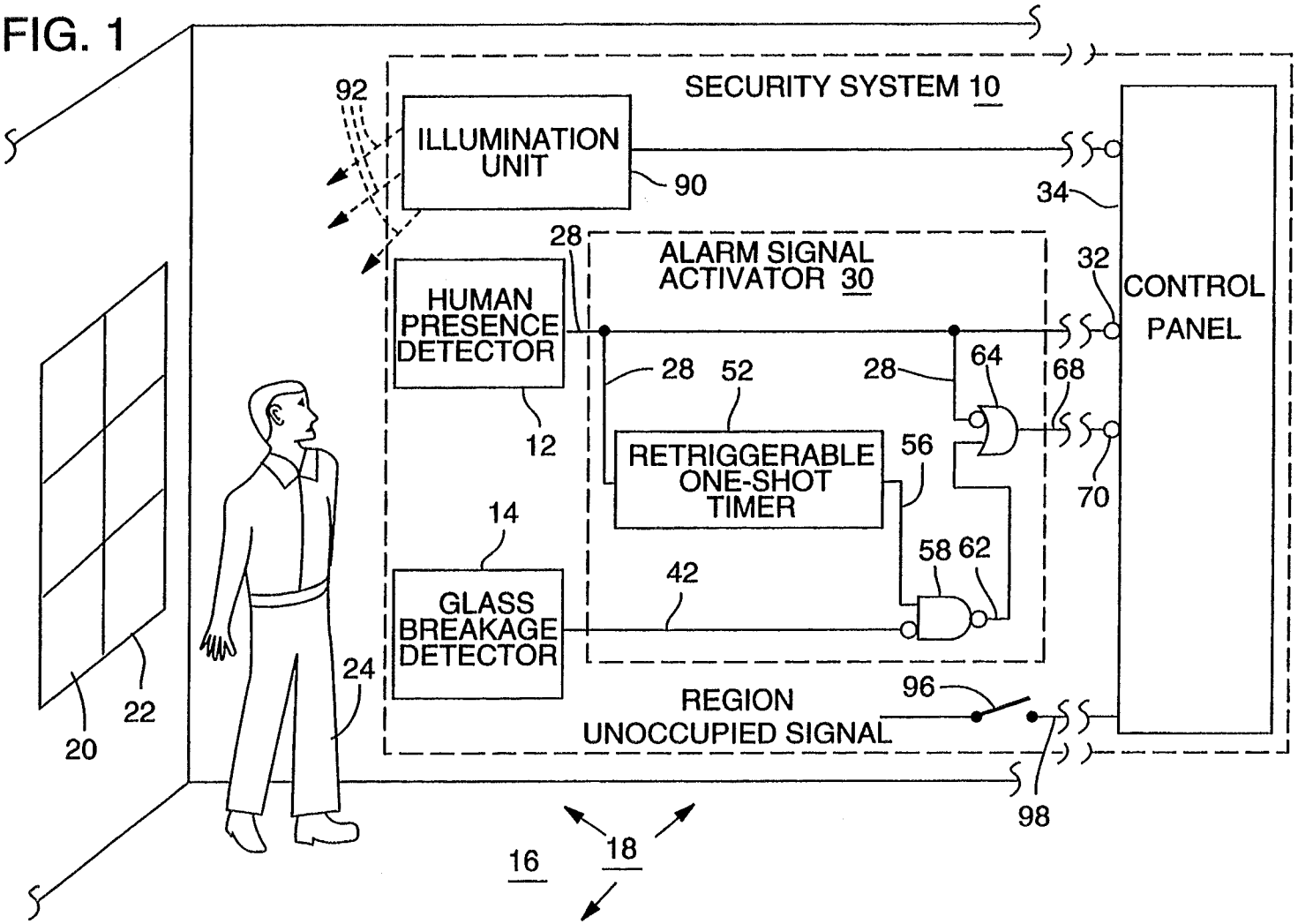
FIG. 1 is a pictorial depiction of a room or region to be protected by a security system according to the invention and includes a schematic block diagram of that security system.
Figure 2:
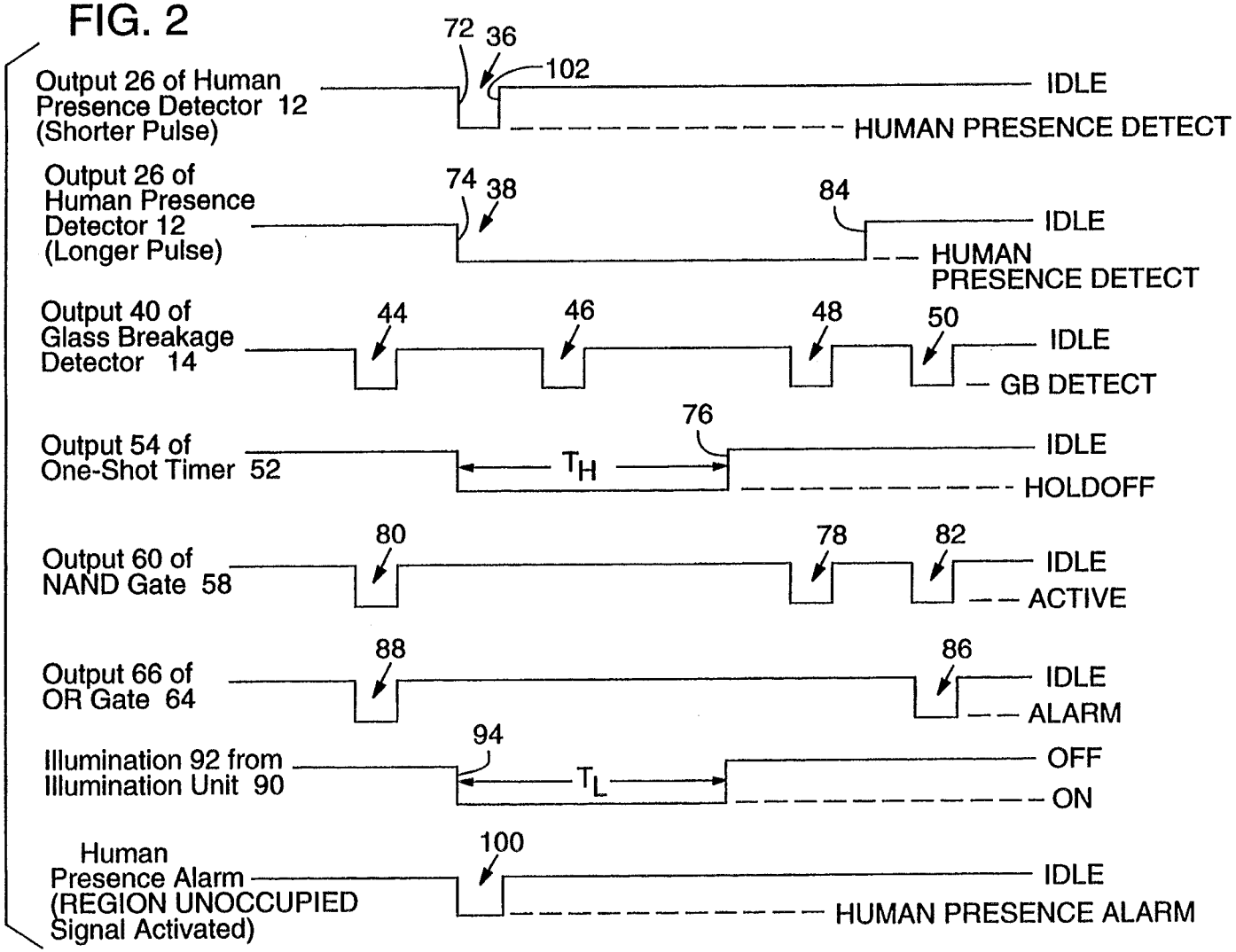
FIG. 2 is a timing diagram showing exemplary signals useful in describing the operation of the security system of FIG. 1 under various conditions.

With reference to FIGS. 1 and 2, a security system 10 has a human presence detector 12 and a glass breakage detector 14 of preferably an acoustic type, each installed to monitor all or part of an inside region, enclosure, or room 16 of a business, home, or other structure 18. A glass surface or pane 20 such as found in a window 22 or glass door (not shown) separates room 16 from an outside region (not shown) from which an intruder (not shown) may break glass pane 20 as, as an example, a step in forcibly entering room 16. A person 24 is legitimately present, and carries on ordinary household or business activities, in room 16.

Human presence detector 12 produces an output signal 26 (FIG. 2) on signal path or line 28 that leads to an alarm signal activator 30 and to an inverting input 32 to a control panel or central control panel 34. A logic high level of output signal 26 indicates an IDLE state in which human presence detector 12 has not detected human presence in room 16. A logic low level of output signal 26 (e.g., a shorter pulse 36 or a longer pulse 38) indicates a HUMAN PRESENCE DETECT state in which human presence detector 12 has detected human presence in room 16.

Human presence detector 12 includes one or more detector units (not shown), each based on any one or more of different technologies for detecting human presence.

When human presence detector 12 includes a motion detector unit, the motion detector unit may be a passive infrared ("PIR") detector. A typical PIR detector is made and sold by Sentrol, Inc., of Portland, Oreg. ("Sentrol"), as Model No. 6255, the lens of which is described in U.S. patent application No. 07/850,339 of Marman et al., filed Mar. 11, 1992, and assigned to the assignee of the instant application. The motion detector unit may alternatively be any type of detector that detects motion by a human being and adequately screens against detecting non-human motion, e.g., movement of pets or other animals. It may be of an acoustic type (e.g., as described in U.S. Pat. Nos. 4,241,338 or 5,185,593), a microwave type (e.g., as described in U.S. Pat. Nos. 4,882,567, 5,077,548, or 5,276,427), or an ultrasonic type (e.g., as described in U.S. Pat. No. 5,189,393).

Human presence detector 12 may also include a detector unit based on other technologies used as an alternative to or in addition to a motion detector, particularly where pets are present. Such other technologies include the following:

A strain detector is attached to floor joists and detects the presence of a human being standing on the floor above through strain induced into the floor support structure. One such detector is the "Pulsor" manufactured by Sure Action Corp. of Southampton, N.Y.

A tactile detector, such as a floor mat detector, is placed under carpeting and detects the presence of a human being standing on the floor. Some floor mat detectors use embedded switches; others use a pneumatic hose connected to a pressure switch.

A photoelectric detector has a light source that illuminates a room. A receiver receives the energy reflected from the light source; changes in the reflected energy indicate human presence. The light source and receiver usually operate with near-infrared light; typical of such detectors are the AX and OA series of photoelectric detectors made by Optex, Inc., of Torrance, Calif. Laser detectors based on the same principle are made by Millennium Sensor Corp. of Lafayette, Colo.

A chemical detector detects chemicals (such as increased levels of carbon dioxide) associated with human presence in a room.

U.S. Pat. Nos. 4,882,567, 5,077,548, 5,276,427, and 5,189,393 are examples of human presence detectors that use more than one different type of technology to determine human presence.

Different technologies that may be used in human presence detector 12 cause that component to place its output 26 in the HUMAN PRESENCE DETECT state for different lengths of time. Some detector units or technologies produce shorter output pulses such as pulse 36 (FIG. 2) (e.g., a motion detector unit produces a short pulse when a human being moves for a short time and then remains still). Other technologies produce longer output pulses such as pulse 38.

Glass breakage detector 14 produces an output signal 40 (FIG. 2) on signal path or line 42 that also leads to alarm signal activator 30. A logic high level of output signal 40 indicates an IDLE state in which glass breakage detector 14 has detected no event that may indicate glass breakage in room 16. Pulses 44, 46, 48, and 50 (FIG. 2) at a logic low level of output signal 40 indicate a GB DETECT state in which glass breakage detector 14 has detected a potential glass breakage event in room 16. The event could be a genuine instance of glass breakage, or it could be triggered by activities of person 24. Pulses 44, 46, 48, and 50 are the intended output of glass breakage detector 14; they are preferably not a signal representing some but not all of the logic of a multi-channel acoustic glass breakage detector. They are of relatively short duration; this permits glass breakage detector 14 to signal separately each detected event that may indicate glass breakage.

Glass breakage detector 14 is, for example, a Sentrol Model No. 5810 two-channel acoustic glass breakage detector described in U.S. Pat. No. 5,192,931 to Smith et al. Alternatively, glass breakage detector 14 could be a three-channel acoustic glass breakage detector of the type about to be introduced by Sentrol as Sentrol Model No. 5810A and described in U.S. patent application No. 08/085,634 of Smith, filed Jun. 30, 1993, and assigned to the assignee of the instant application. Other acoustic glass breakage detectors are commercially available.

Alarm signal activator 30 includes a retriggerable one-shot timer 52 that receives at its input the output signal 26 of human presence detector 12. Timer 52 is any suitable timer such as a Motorola MC14541B programmable timer. Timer 52 has an output 54 (FIG. 2) carried over signal path or line 56 to one input of a two-input NAND gate 58. Output signal 40 of glass breakage detector 14 is inverted and applied to the other input of NAND gate 58. The output 60 of NAND gate 58 (FIG. 2) is carried over signal path or line 62 to one input to a two-input OR gate 64. Output signal 26 of human presence detector 12 is inverted and applied to the other input of OR gate 64. The output 66 of OR gate 64 leads over a signal path or line 68 to an inverting input 70 to control panel 34.

Alarm signal activator 30 has four basic functions, which are implemented by timer 52, NAND gate 58, and OR gate 64.

First, when outputs 26 of human presence detector 12 and 40 of glass breakage detector 14 are in their respective IDLE states, output 66 of OR gate 64 on line 68 is at a logic high level, indicating an IDLE condition to control panel 34.

Second, alarm signal activator 30 does not indicate an ALARM condition to control panel 34 when glass breakage detector 14 indicates a GB DETECT state within a predetermined holdoff time interval $T_H$ after the beginning of a most recent HUMAN PRESENCE DETECT state of output 26 of human presence detector 12. This function is particularly useful when human presence detector 12 is of a type that produces shorter pulses of the HUMAN PRESENCE DETECT state.

Third, alarm signal activator 30 does not indicate an ALARM condition to control panel 34 when glass breakage detector 14 indicates a GB DETECT state while human presence detector 12 indicates a HUMAN PRESENCE DETECT state. This function is particularly useful when human presence detector 12 is of a type that produces longer pulses of the HUMAN PRESENCE DETECT state.

Fourth, when output 26 of human presence detector 12 is in its IDLE state after holdoff time interval $T_H$ after leading or falling edge 72 or 74 of shorter pulse 36 or longer pulse 38, respectively, or has not yet been in its HUMAN PRESENCE DETECT state, alarm signal activator 30 indicates an ALARM condition to control panel 34 in response to a GB DETECT state of output 40 of glass breakage detector 14.

The first function is implemented as follows. Output 54 of timer 52 is at a logic high level, indicating an IDLE condition, before timer 52 is triggered or retriggered. When human presence detector 12 and glass breakage detector 14 also indicate IDLE conditions, outputs 60 of NAND gate 58 and 66 of OR gate 64 are at logic high levels, indicating an IDLE state to control panel 34.

The second function is implemented by timer 52 and NAND gate 58. Output 54 of timer 52 switches to a logic low level, indicating a HOLDOFF state, at leading or falling edge 72 of pulse 36 or 74 of pulse 38 and remains low for holdoff time interval $T_H$ (FIG. 2), which is chosen on the basis of anticipated activity of person 24, i.e., independently of the internal logic of glass breakage detector 14, and is typically in a range from about 30 seconds to about 10 minutes. Shorter pulse 36 is shorter than, and longer pulse 38 is longer than, holdoff time interval $T_H$. The falling edge of any additional HUMAN PRESENCE DETECT pulse (not shown) of output signal 26 that occurs while output 54 of timer 52 is at a logic low level retriggers timer 52 and causes its output 54 to remain at the logic low level for the holdoff time interval $T_H$ after that falling edge.

During the running of the holdoff time interval, the output of glass breakage detector 14 is not allowed to change the output of NAND gate 58 from the IDLE to the ACTIVE state. Output 54 of timer 52 is at a logic low level for the holdoff time interval $T_H$ after each detection by human presence detector 14 of human presence in region 16 (e.g., pulses 36 or 38 of FIG. 2); this inhibits any GB DETECT state of output signal 40 (e.g., pulse 46 of FIG. 2) from transmitting through NAND gate 58 to OR gate 64 and thence to control panel 34. This effectively "disarms" glass breakage detector 14 and thereby prevents possible false alarms from being caused by activities of person 24 for the holdoff time interval $T_H$ after each detection of human presence.

The third function is carried out by OR gate 58. When human presence detector 12 has an output 26 in the HUMAN PRESENCE DETECT state for longer than holdoff time interval $T_H$ after the most recent transition to that state (e.g., longer pulse 38), output 54 of timer 52 returns to its IDLE state (e.g., transition 76). In such circumstances a GB DETECT state of output 40 of glass breakage detector 14 (e.g., GB DETECT event 48) changes the state of output 60 of NAND gate 58 (e.g., event 78) and thereby changes the state of the input on line 62 of OR gate 64. However, the other input to OR gate 64 is the inversion of output 26 of human presence detector 12; that inversion is at a logic high level throughout the duration (e.g., event 78) of the ACTIVE condition of output 60 of NAND gate 58. The logic high level of that other input to OR gate 64 blocks the logic low level of output 60 of NAND gate 58 from causing output 66 of OR gate 64 to change from a logic high or IDLE state to a logic low or ALARM state. This effectively "disarms" glass breakage detector 14 while human presence in region 16 is being detected.

The fourth function is carried out as follows. After holdoff time interval $T_H$ has passed following a most recent transition of output 26 of human presence detector 12 from its IDLE state to its HUMAN PRESENCE DETECT state, output 54 of timer 52 returns to a logic high level (e.g., transition 76 of FIG. 2). This enables NAND gate 58 to pass the GB DETECT state of output signal 40 by changing the state of output 60 of NAND gate 58. Whenever output signal 40 of glass breakage detector 14 signals an event that may indicate glass breakage (e.g., event detections 44, 48, and 50) when output 54 of timer 52 is in the IDLE state, NAND gate 58 places its output signal 60 at a logic low level, indicating an ACTIVE condition (e.g., respective pulses 80, 78, and 82). In addition, when human presence detector 12 no longer detects the presence of a human being in region 16, its output 26 goes to a logic high level (e.g., transition 84), which drives the input to OR gate 64 stemming from line 28 to a logic low level, thus enabling OR gate 64. The combined result of enabling both NAND gate 58 and OR gate 64 effectively "rearms" glass breakage detector 14: any alarm condition signalled by glass breakage detector 14 will transmit to control panel 34 (e.g., GB DETECT pulse 50, ACTIVE pulse 82, and ALARM pulse 86 of FIG. 2). The same result occurs when human presence detector 12 has not yet been in its HUMAN PRESENCE DETECT state (e.g., pulses 44, 80, and 88 of FIG. 2). This allows system 10 to signal an event that may indicate glass breakage that occurs other than during the holdoff time interval $T_H$ after any detection by human presence detector 14 of human presence in region 16 and other than when that detector is detecting human presence in that region.

Output signals 26, 40, 54, 60, and 66 shown in FIG. 2 show the operation of security system 10 pursuant to various conditions of human presence detector 12 and glass breakage detector 14. However, in a typical application human presence detector 12 has its output 26 in the HUMAN PRESENCE DETECT state from zero to one thousand times or more before glass breakage detector 14 has its output 40 in the GB DETECT state as a false alarm. In addition, a true glass breakage event occurs very infrequently in actual use. Human presence detector 12 typically has its output 26 in the HUMAN PRESENCE DETECT state many thousands of times before a true glass breakage intrusion event occurs.

Line 28 leads to inverting input 32 to control panel 34 to implement an additional, optional response to a detection of human presence. When a HUMAN PRESENCE DETECT pulse such as pulse 36 appears on line 28, control panel 34 optionally activates a service or illumination unit 90 to provide a service (e.g., illumination 92 visible to a human being for room 16 (e.g., transitions 72 and 94 of FIG. 2)); when the level on line 28 is high, control panel 34 deactivates service or illumination unit 90 and turns off service or illumination 92 after a delay interval. This provides a service (e.g., light to room 16) for a service or illumination time interval $T_L$ following each detection of human presence in room 16. $T_L$ can be greater than, less than, or (as shown in FIG. 2) the same as holdoff time interval $T_H$. An override switch (not shown) could also be provided to allow service or illumination unit 90 to be controlled independently of output 26 of human presence detector 12.

When persons are not expected to enter room 16, a REGION UNOCCUPIED signal is optionally activated by closing switch 96 and is sent over line 98 to control panel 34. Whenever the REGION UNOCCUPIED signal is active, any detection of human presence in room 16 triggers a HUMAN PRESENCE ALARM condition through pulse 100; and whenever the REGION UNOCCUPIED signal is not active, detection of human presence in room 16 does not trigger the human presence alarm condition.

The functional units of FIG. 1 may be housed in a number of different ways. Human presence detector 12, glass breakage detector 14, and alarm signal activator 30 may be installed in one protective housing, separate protective housings, or various combinations of protective housings. Alarm signal activator 30 can be installed within control panel 34, and human presence detector 12 and glass breakage detector 14 can be installed either in one or in separate protective housings. Control panel 34 need not be located in room 16 and typically is located elsewhere.

Output signals 26, 40, and 66 are shown in the conventional format in which a logic high level indicates an IDLE state and a logic low level indicates an active state. That format assists in detecting power failures such as low batteries and thus in verifying that system 10 will be functional when needed. However, one or more of those signals could be implemented with suitable modifications in a design (not shown) such as for a portable or battery powered security system or component of a security system in which a logic high level indicates an alarm condition and a logic low level indicates an idle condition. Signal paths 28, 42, 56, 62, and 68 need not be hard-wired; they can be electromagnetic pathways for wireless signals or optical pathways (e.g., optical fibers) for optical signals. Power for the functional units of FIG. 1 can be provided from batteries inside those units, from conventional sources of electric power, or from control panel 34.

Security system 10 could also be implemented in an alternative that is as shown in FIG. 1 but with a retriggerable one-shot timer that is triggered at trailing or rising edge 102 of pulse 36 or 84 of pulse 38 and that remains low for holdoff time interval $T_H$ after being triggered or retriggered. In such an alternative implementation OR gate 64 blocks any GB DETECT state of output signal 40 (e.g., pulses 46 and 48) from transmitting from NAND gate 58 to control panel 34 while human presence detector 26 has its output 26 in the HUMAN PRESENCE DETECT state. In such an alternative NAND gate 58 blocks any GB DETECT state of output signal 40 that occurs within holdoff time interval $T_H$ after rising edge 102 or 84 from transmitting through NAND gate 58 and thence through OR gate 64 to control panel, 34. An equivalent to that alternative has the timer retriggered (e.g., retriggered continuously or periodically with a period less than or equal to $T_H$) while output signal 26 is in the HUMAN PRESENCE DETECT state.

Because the invention greatly decreases the risk of a false alarms resulting from activity of person 24, glass breakage detector 14 may be designed for much higher sensitivity to the sound of breaking glass than is customary when it is used alone, thereby improving its detection reliability or range.

It will be apparent to skilled persons that many changes may be made to details of the specific embodiments of the invention described herein without departing from the underlying principles thereof. There are other ways of producing a HUMAN PRESENCE DETECT signal and of inhibiting a GB DETECT state of output 40 of glass breakage detector 14 from signalling an ALARM to control panel 34 when activities of a human being legitimately present in region 16 may be the source of the GB DETECT state. The scope of the invention should, therefore, be determined only by the following claims.

I claim:

1. A method of operating a security system to produce an alarm signal indicative of glass breakage in a region in which a person may legitimately be present, comprising:

producing with a human presence detector an output signal that is in a human presence detect state in response to detection by the human presence detector of human presence in the region and that exits that state if the human presence detector does not continue to detect human presence in the region;

detecting with a glass breakage detector an occurrence of an event that may indicate glass breakage;

producing, with an alarm signal activator operatively coupled to the human presence and glass breakage detectors, the alarm signal in response to a detection with the glass breakage detector of an occurrence of the event more than a predetermined holdoff time interval after a time when the output signal is in the human presence detect state; and not producing the alarm signal in response to a detection with the glass breakage detector of an occurrence of the event within the predetermined holdoff time interval after the time when the output signal is in the human presence detect state.

2. The method of claim 1, wherein producing the human presence detect signal further comprises changing the state of the output signal to the human presence detect state and maintaining the output signal in the human presence detect state while the human presence detector continues to detect human presence in the region.

3. The method of claim 1, wherein detecting the presence of a human being in the region comprises detecting human motion in the region.

4. The method of claim 1, wherein the holdoff time interval is determined on the basis of anticipated activity of the legitimately present person.

5. The method of claim 1, further comprising:

producing a region unoccupied signal for a time interval in which the person is not expected to be legitimately present in the region; and producing a human presence alarm in response to detection by the human presence detector of human presence in the region while the region unoccupied signal is produced.

6. The method of claim 1, further comprising:

providing a service for a predetermined service time interval in response to a detection by the human presence detector of human presence in the region; and ending the service after the service time interval has elapsed following the detection of human presence.

7. The method of claim 6, wherein providing the service comprises providing to the region illumination visible to human beings, and the service time interval comprises an illumination time interval.

8. The method of claim 7, wherein the illumination time interval and the holdoff time interval are of equal duration.

9. The method of claim 1, wherein:

producing the alarm signal comprises producing the alarm signal in response to a detection with the glass breakage detector of an occurrence of the event other than within the predetermined holdoff time interval after a most recent time at which the output signal has entered the human presence detect state; and not producing the alarm signal comprises not producing the alarm signal in response to a detection with the glass breakage detector of the occurrence of the event within the predetermined holdoff time interval after the most recent time at which the output signal has entered the human presence detect state.

10. The method of claim 1, wherein:

producing the alarm signal comprises producing the alarm signal in response to a detection with the glass breakage detector of an occurrence of the event other than within the predetermined holdoff time interval after a most recent time at which the output signal has exited that state; and not producing the alarm signal comprises not producing the alarm signal in response to the detection of the occurrence of the event within the predetermined holdoff time interval after the most recent time at which the output signal has exited that state.

11. The method of claim 1, wherein:

producing the alarm signal comprises producing the alarm signal in response to a detection with the glass breakage detector of an occurrence of the event other than within the predetermined holdoff time interval after a most recent one of periodic times that follow a most recent time at which the output signal has entered the human presence detect state and that occur while the output signal is in the human presence detect state; and not producing the alarm signal comprises not producing the alarm signal in response to the detection with the glass breakage detector of the occurrence of the event within the predetermined holdoff time interval after the most recent one of the periodic times that follow the most recent time at which the output signal has entered the human presence detect state.

12. The method of claim 1, wherein:

producing the alarm signal comprises producing the alarm signal in response to a detection with the glass breakage detector of an occurrence of the event other than within the predetermined holdoff time interval after a most recent time at which the output signal was in the human presence detect state; and not producing the alarm signal comprises not producing the alarm signal in response to the detection of the occurrence of the event within the predetermined holdoff time interval after the most recent time at which the output signal is in the human presence detect state.

13. A method of operating a security system to produce an alarm signal indicative of glass breakage in a region in which a person may legitimately be present, comprising:

producing with a human presence detector an output signal that is in a human presence detect state in response to detection by the human presence detector of human presence in the region and that exits that state if the human presence detector does not continue to detect human presence in the region;

detecting with a glass breakage detector an occurrence of an event that may indicate glass breakage;

producing, with an alarm signal activator operatively coupled to the human presence and glass breakage detectors, the alarm signal in response to a detection with the glass breakage detector of an occurrence of the event that takes place other than while the output signal is in the human presence detect state; and not producing the alarm signal in response to a detection with the glass breakage detector of an occurrence of the event that takes place while the output signal is in the human presence detect state.

14. The method of claim 13, further comprising:

producing the alarm signal in response to a detection with the glass breakage detector of an occurrence of the event that takes place other than within a predetermined holdoff time interval after a time when the output signal is in the human presence detect state; and not producing the alarm signal in response to the detection with the glass breakage detector of the occurrence of the event that takes place within the predetermined holdoff time interval after the time in which the output signal is in the human presence detect state.

15. The method of claim 14, further comprising not producing the alarm signal in response to a detection with the glass breakage detector of an occurrence of the event that takes place within a predetermined holdoff time interval after a time at which the output signal has entered the human presence detect state.

16. The method of claim 13, wherein detecting the presence of a human being in the region comprises detecting human motion in the region.

17. A security system operable to produce an alarm signal indicative of glass breakage in a region in which a person may legitimately be present, comprising:

a human presence detector operatively coupled to the region and operable to produce an output signal that is in a human presence detect state in response to detection by the human presence detector of human presence in the region and that exits that state if the human presence detector does not continue to detect human presence in the region;

a glass breakage detector operable to produce a detect signal in response to detection by it of an occurrence of an event that may indicate glass breakage; and an alarm signal activator operatively connected to the human presence and glass breakage detectors and operable to produce the alarm signal in response to production of the detect signal when production of the detect signal occurs more than a predetermined holdoff time interval after a time when the output signal is in the human presence detect state and further operable not to produce the alarm signal when production of the detect signal occurs during the predetermined holdoff time interval after the time when the output signal is in the human presence detect state.

18. The system of claim 17, wherein the alarm signal activator comprises:

a retriggerable one-shot timer that is in operative communication with the human presence detector, that is triggered into an active state by entry of the output signal into the human presence detect state and that, when in the active state, has an output with a pulse width equal to the holdoff time interval; and a logic unit in operative communication with the timer, the human presence detector, and the glass breakage detector and that holds off production of the alarm signal whenever the detect signal is produced while the timer is in the active state.

19. The system of claim 17, wherein the human presence detector comprises a detector unit of one or more of the passive infrared, ultrasonic, microwave, strain, tactile, photoelectric, and chemical types.

20. The system of claim 17, wherein the human presence detector does not comprise a detector unit of an acoustic type.

21. The system of claim 17, wherein the human presence detector comprises a unit of a type that detects human motion.

22. The system of claim 17, wherein the glass breakage detector is of an acoustic type.

23. The system of claim 17, further comprising a protective housing containing the human presence and glass breakage detectors and the alarm signal activator.

24. The system of claim 17, further comprising first, second, and third separate protective housings containing a respective one of the human presence detector, the glass breakage detector, and the alarm signal activator.

25. The system of claim 17, further comprising first and second separate protective housings, each containing a respective one of the human presence and glass breakage detectors, and wherein one of the housings contains the alarm signal activator.

26. The system of claim 17, further comprising a control panel containing the alarm signal activator.

27. The system of claim 17, wherein the alarm signal activator is further operable to produce the alarm signal in response to production of the detect signal when production of the detect signal occurs other than within the predetermined holdoff time after a most recent time at which the output signal has entered the human presence detect state; and the alarm signal activator is further operable not to produce the alarm signal in response to production of the detect signal when production of the detect signal occurs within the predetermined holdoff time interval after the most recent time at which the output signal has entered the human presence detect state.

28. The system of claim 17, wherein the alarm signal activator is further operable to produce the alarm signal in response to production of the detect signal when production of the detect signal occurs other than within the predetermined holdoff time after a most recent time at which the output signal has exited that state; and the alarm signal activator is further operable not to produce the alarm signal in response to production of the detect signal when production of the detect signal occurs within the predetermined holdoff time interval after the most recent time at which the output signal has exited that state.

29. The system of claim 17, wherein the alarm signal activator is further operable to produce the alarm signal in response to production of the detect signal when production of the detect signal occurs other than within the predetermined holdoff time after a most recent one of periodic times that follow a most recent time at which the output signal entered the human presence detect state before leaving that state and that occur while the output signal is in the human presence detect state; and the alarm signal activator is further operable not to produce the alarm signal in response to production of the detect signal when production of the detect signal occurs within the predetermined holdoff time interval after a most recent one of periodic times that follow a most recent time at which the output signal has entered the human presence detect state and that occur while the human presence detect signal is in the human presence detect state.

30. The system of claim 17, wherein the alarm signal activator is further operable to produce the alarm signal in response to production of the detect signal when production of the detect signal occurs other than within the predetermined holdoff time after a most recent time at which the output signal was in the human presence detect state; and the alarm signal activator is further operable not to produce the alarm signal in response to production of the detect signal when production of the detect signal occurs within the predetermined holdoff time interval after a most recent time at which the output signal was in the human presence detect state.

31. A security system operable to produce an alarm signal indicative of glass breakage in a region in which a person may legitimately be present, comprising:

a human presence detector operatively coupled to the region and operable to produce an output signal that is in a human presence detect state in response to detection by the human presence detector of human presence in the region and that exits that state if the human presence detector does not continue to detect human presence in the region;

a glass breakage detector operable to produce a detect signal in response to detection by it of an occurrence of an event that may indicate glass breakage; and an alarm signal activator operatively connected to the human presence and glass breakage detectors and operable to produce the alarm signal in response to production of the detect signal when production of the detect signal occurs other than while the output signal is in the human presence detect state and further operable not to produce the alarm signal when production of the detect signal occurs while the output signal is in the human presence detect state.

32. The system of claim 31, wherein the alarm signal activator is further operable to produce the alarm signal only when production of the detect signal occurs other than within a predetermined holdoff time interval after a most recent time at which the output signal is in the human presence detect state.

33. The system of claim 31, wherein the human presence detector is of a type that detects human motion.

* * * * *